US008413360B2

(12) United States Patent
Walters

(10) Patent No.: US 8,413,360 B2
(45) Date of Patent: Apr. 9, 2013

(54) COMBINED BOLLARD COVERING AND ADVERTISING ASSEMBLY

(76) Inventor: Jacob Walters, Eden Prairie, MN (US)

( * ) Notice: Subject to any disclaimer, the term of this patent is extended or adjusted under 35 U.S.C. 154(b) by 73 days.

(21) Appl. No.: 12/945,199

(22) Filed: Nov. 12, 2010

(65) Prior Publication Data

US 2011/0107635 A1 May 12, 2011

Related U.S. Application Data

(60) Provisional application No. 61/260,427, filed on Nov. 12, 2009.

(51) Int. Cl.
*G09F 7/00* (2006.01)

(52) U.S. Cl.
USPC ..... 40/612; 40/607.03

(58) Field of Classification Search ..... 40/439, 40/607.03; 52/2.13, 2.21, 2.22, 2.11, 38, 52/105
See application file for complete search history.

(56) References Cited

U.S. PATENT DOCUMENTS

| | | | | |
|---|---|---|---|---|
| 5,116,204 | A | 5/1992 | Power | |
| 5,299,883 | A | 4/1994 | Arth | |
| 5,323,583 | A | 6/1994 | Venegas | |
| 5,487,618 | A | 1/1996 | Cox | |
| 5,605,414 | A * | 2/1997 | Fuller et al. | 40/607.11 |
| 5,956,875 | A | 9/1999 | Aughenbaugh | |
| 6,061,939 | A | 5/2000 | Gildea | |
| 6,209,276 | B1 | 4/2001 | Venegas | |
| D465,585 | S | 11/2002 | Venegas | |
| 6,692,182 | B1 | 2/2004 | Fenimore | |
| 6,779,287 | B2 | 8/2004 | Venegas | |
| 6,971,198 | B2 | 12/2005 | Venegas | |
| 7,150,117 | B2 | 12/2006 | Venegas | |
| 7,351,003 | B1 | 4/2008 | Fenimore | |
| 2002/0056251 | A1 | 5/2002 | Venegas | |
| 2004/0060257 | A1 | 4/2004 | Venegas | |
| 2005/0076586 | A1 | 4/2005 | Venegas | |
| 2006/0075666 | A1 * | 4/2006 | Thielemans et al. | 40/448 |
| 2006/0113515 | A1 | 6/2006 | Venegas | |
| 2006/0185998 | A1 * | 8/2006 | McGrail et al. | 206/315.3 |
| 2006/0213530 | A1 | 9/2006 | Venegas | |
| 2008/0263925 | A1 | 10/2008 | Berg | |
| 2009/0255841 | A1 * | 10/2009 | Sanches et al. | 206/522 |

* cited by examiner

*Primary Examiner* — Joanne Silbermann
*Assistant Examiner* — Kristina Junge
(74) *Attorney, Agent, or Firm* — Merchant & Gould P.C.

(57) ABSTRACT

A bollard covering and advertisement assembly constructed to protect a bollard structure from damage incurred from various surface and structural degrading phenomena, and further include one or more advertising indicia to increase the visibility of the bollard structure and convey messages.

18 Claims, 6 Drawing Sheets

COMBINED BOLLARD COVERING AND ADVERTISING ASSEMBLY

BACKGROUND

Bollards are typically set in place to obstruct passage of pedestrian and vehicle traffic. As such, they are continuously subjected to various surface and structural damaging phenomena, including weathering, pollution, vandalism, physical contact, and others. In many instances, these phenomena reduce the service lifetime of a bollard.

SUMMARY

In a first aspect, a first example bollard covering and advertisement assembly is disclosed. The first example assembly includes a first and second insulating layer. The first layer includes an exposed external surface formed from a damage resistant material. The first example assembly additionally includes an inflatable third layer positioned between the first and second layers. The first, second and third layers are adjacently positioned and affixed with respect to one another. Furthermore, the one or more advertising indicia are coupled to the external surface.

In a second aspect, a second example combined bollard covering and advertisement assembly is disclosed. The second example assembly is removably coupled to at least a portion of a bollard structure to protect the bollard structure from one or more surface damaging phenomena. The second example assembly includes a first and second layer each formed from an insulating material, the first layer includes an exposed external surface formed from a durable, damage resistant material. The second example assembly additionally includes an inflatable third layer positioned between the first and second layers. The first, second and third layers are adjacently positioned and affixed with respect to one another to integrally form a flexible U-shaped assembly including an open end adjacent to a cavity. Furthermore, one or more indicia each including an advertisement message are coupled to the external surface.

In a third aspect, a method of coupling a combined bollard covering and advertisement assembly to a bollard structure is disclosed. The method includes partially inflating the assembly by introducing a fluid substance into an inflatable middle layer of the assembly. The middle layer is adjacently positioned and affixed between a first and a second layer, and the first layer includes an exposed external surface including one or more advertising indicia. Next, the assembly is removably coupled to the bollard structure by coincidentally aligning an end of the bollard structure with an open end of the assembly and moving the assembly in a parallel direction with respect to a longitudinal axis of the bollard structure. The end of the bollard structure is inserted into a cavity adjacent to the open end of the assembly. Next, the middle layer is substantially filled with the fluid substance such that a pressure force is imparted on a surface of bollard structure covered by the assembly. Next, the assembly is secured to the bollard structure.

DESCRIPTION OF THE DRAWINGS

Aspects of the disclosure may be more completely understood in consideration of the following detailed description of various embodiments of the disclosure in connection with the accompanying drawings, wherein.

DETAILED DESCRIPTION

The example embodiments described in the following disclosure are provided by way of illustration only and should not be construed as limiting. Various modifications and changes may be made to the example embodiments described below without departing from the true spirit and scope of the disclosure.

The present disclosure relates generally to a bollard covering. More specifically, the present disclosure relates to a combined bollard covering and advertisement assembly.

In the following example embodiments, the bollard covering and advertisement assembly is constructed to: a) protect a bollard structure from damage incurred from various surface and structural degrading phenomena; and b) include one or more advertising indicia to increase the visibility of the bollard structure and convey messages. Although the present disclosure is not so limited, an appreciation of the various aspects of the disclosure will be gained through a discussion of the examples provided below.

Figure 1:
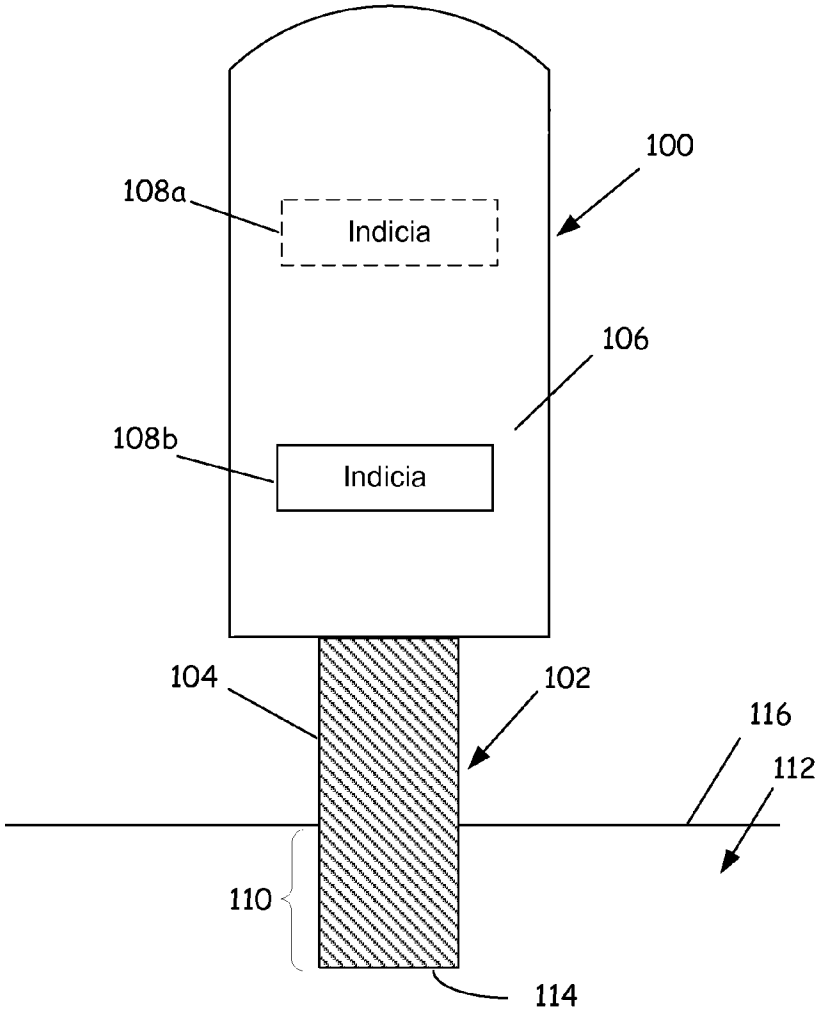
FIG. 1 is a side view of an example bollard covering and advertisement assembly coupled to a bollard structure.

Referring now to FIG. 1, an example bollard covering and advertisement assembly 100 is shown. In general, the assembly 100 is coupled to at least a portion of a bollard structure 102 to protect the bollard structure 102 from various damaging phenomena, thereby effectively increasing a service lifetime of the bollard structure 102.

In one aspect, the assembly 100 is constructed to protect the bollard structure 102 from one or surface damaging mechanisms. For example, the assembly 100 of the present disclosure is constructed to protect at least a portion of a surface 104 of the bollard structure 102 from damage incurred via weathering, pollution, vandalism, and other surface damaging mechanisms.

Additionally, the assembly 100 is constructed to protect the bollard structure 102 from an impact with a moving structure. For example, the assembly 100 of the present disclosure can be configured to protect the bollard structure 102 from damage due to physical contact with a motor vehicle (e.g., a vehicle door, bumper, etc.). The assembly 100 additionally provides a mechanism to minimize potential damage to the moving structure that is involved in the incident impact.

In example embodiments, the assembly 100 includes, in part, an external surface 106 that is preferably formed from a material that is both capable of withstanding an impact without incurring substantial damage, and further is resistant to other surface damaging mechanisms, as briefly described above.

The external surface 106 of the present disclosure additionally includes a preventative mechanism to decrease impact event frequency by virtue of increasing visibility of the bollard structure 102. It will be appreciated that visibility of the bollard structure 102 is a key component in reducing impact events.

For example, in one embodiment, the external surface 106 of the assembly 100 includes one or more advertising indicia 108*a-b* (collectively, advertising indicia 108) positioned thereon. In general, the advertising indicia 108 can be located at any site on the external surface 106. Additionally, the advertising indicia 108 can be positioned in any orientation on the external surface 106.

In example embodiments, the advertising indicia 108 includes a message that can be, for example, any type of visual, audio, or otherwise perceivable message. For example, the advertising indicia 108 can include a message comprising an image, such as lettering, graphics, and the like that generally can be electronically generated and/or formed from materials such as synthetics (e.g., plastics, paint, and others) and non-synthetics (e.g., wood, bio-polymer, and other organic materials).

Additionally, the advertising indicia 108 can include a message that has an audio component, such as a sound that indicates presence of the bollard structure 102 upon a moving structure entering within a predetermined distance of the bollard structure 102. In this regard, it will be appreciated that the advertising indicia 108 can include any message having characteristics (i.e., size, color, tone) that has an influence on the visibility of the advertising indicia 108, in turn increasing the visibility of the bollard structure 102.

In one aspect, the advertising indicia 108 are integrally formed with the external surface 106. In another aspect, the advertising indicia 108 comprise of a separate structure from the external surface 106. For example, embedded advertising indicia 108*a* can include a message that is embedded within the external surface 106 (e.g., ink, stitching, embedded LED's, etc.). Embedded advertising indicia 108*a* is depicted in FIG. 1 as an intermittent line pattern.

As another example, advertising indicia 108*b* can include a message that is incorporated into a structure that is separate from the external surface 106, the separate structure is then coupled to the external surface 106 (e.g., a decal, electronic sign, etc.). An example of separate advertising indicia 108*b* is depicted in FIG. 1 as a solid line pattern. In certain embodiments, separate advertising indicia 108*b* are removably coupled to the external surface 106. In other embodiments, separate advertising indicia 108*b* are permanently coupled to the external surface 106.

Still referring to FIG. 1, the bollard structure 102 generally includes at least a first portion 110 that is positioned within a securing body 112 to secure the bollard structure 102 in a fixed position. However, it will be appreciated that the bollard structure 102 may include one or more portions that are positioned within the securing body 112, depending on the shape and the functional purpose of the bollard structure 102.

The bollard structure 102 can be secured to the securing body 112 via any of a plurality of methods. As depicted, the first portion 110 of the bollard structure 102 is positioned within the securing body 112. Alternatively, the bollard structure 102 can be secured to the securing body 112 by coupling a first end 114 of the bollard structure 102 adjacent to a top surface 116 of the securing body 112 (not shown). Other methods for securing the bollard structure 102 to the securing body 112 are possible as well.

In example embodiments, the bollard structure 102 can be characterized as any type of pole, post, column, pillar, or other structure that is used to provide access control and various other functions. For example, the bollard structure 102 can include features to serve as a security bollard, a pedestrian bollard, a traffic bollard, a retractable/rising bollard, a folding bollard, a landscape/architectural bollard, a mooring bollard, and any other type of unlisted or otherwise specialized bollard. In this regard, it will be appreciated that the bollard structure 102 can generally be any desired shape, size, comprise of any material or compound, include any type of finish, and include any aesthetic and/or otherwise functional features. Additionally, the bollard structure 102 can be installed individually to a securing body 112 or as part of a larger system comprising a plurality of bollard structures 102.

Referring now to FIGS. 2-5, the assembly 100 and the bollard structure 102 of FIG. 1 are shown in more detail. In example embodiments, the bollard structure 102 is a cylindrical structure having dimensions of a length 118 and a radius 120. The first end 114 of the bollard structure 102 is a flat surface. A second end 122 of the bollard structure 102 opposite of the first end 114 is a hemispherically shaped surface. As mentioned above, other embodiments of the bollard structure 102 are possible as well.

Figure 2:
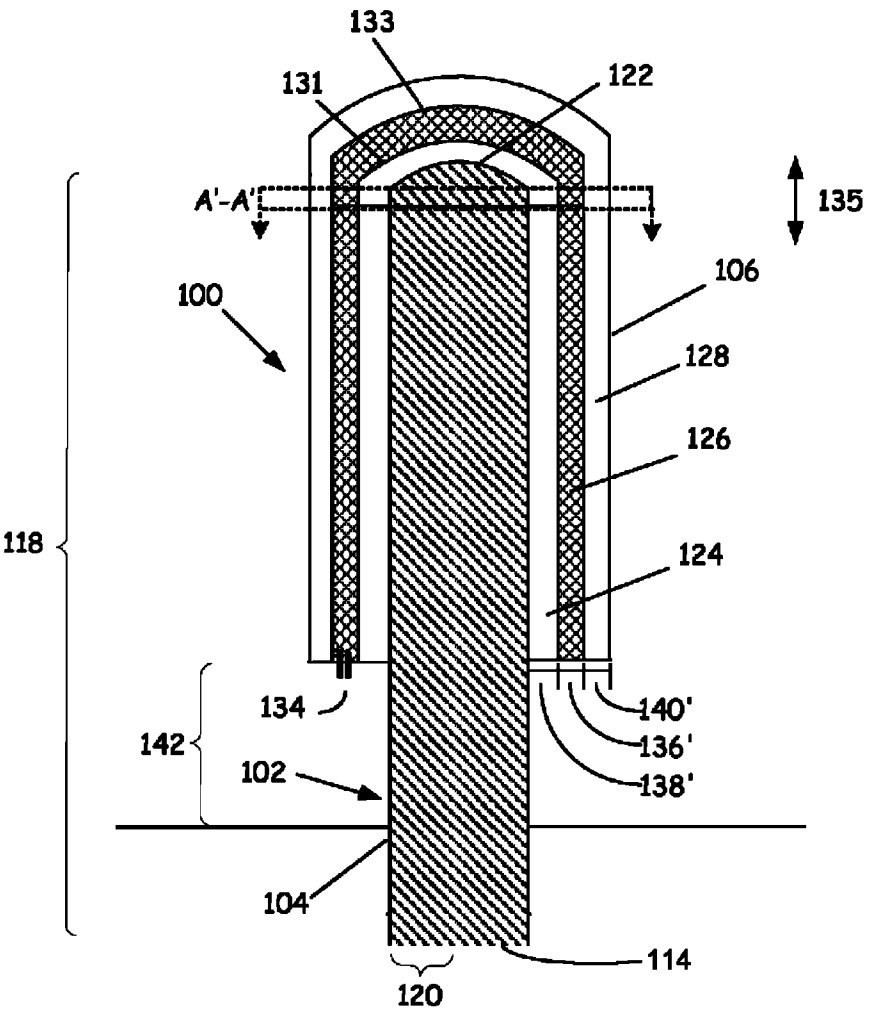
FIG. 2 is a cross-sectional view of the bollard covering and advertisement assembly and bollard structure of FIG. 1.

Although the bollard structure 102 is depicted in FIG. 2 as being partially covered by the assembly 100, it will be appreciated that the assembly 100 can be manufactured such that a length 142 that characterizes an exposed length of the bollard structure 102 can be selected as desired. In example embodiments, approximately ¼ of the bollard structure 102 that is not positioned within the securing body 112 is covered by the assembly 100. However, in certain embodiments, it may be desired that the length 142 approaches zero such that portion of the bollard structure 102 that is not positioned within the securing body 112 is fully covered by the assembly 100.

In example embodiments, the assembly 100 is a flexible U-shaped inflatable assembly comprising of a plurality of connected layers, including an inner layer 124, a middle layer 126, and an outer layer 128. The assembly 100 additionally includes an open end 130 adjacent to a cavity 132. Other embodiments of the assembly 100 are possible as well. For example, in one embodiment, the assembly 100 can be a tube shaped assembly having two open ends adjacent to an inner passage.

In general, the respective layers 124, 126, and 128 are positioned adjacent to each other and are affixed with respect to one another to form an integral assembly. The inner layer 124 and the middle layer 126 are in contact with each other along a first interface 131. The middle layer 126 and the outer layer 128 are in contact with each other along a second interface 133.

In one embodiment, the middle layer 126 is a flexible diaphragm that can be filled with a fluid substance. The fluid substance can be, for example, a liquid, a gas, a colloid, and others. A two-way valve 134 enables the fluid substance to be transferred between the middle layer 126 and an external source (not shown).

Figure 4:
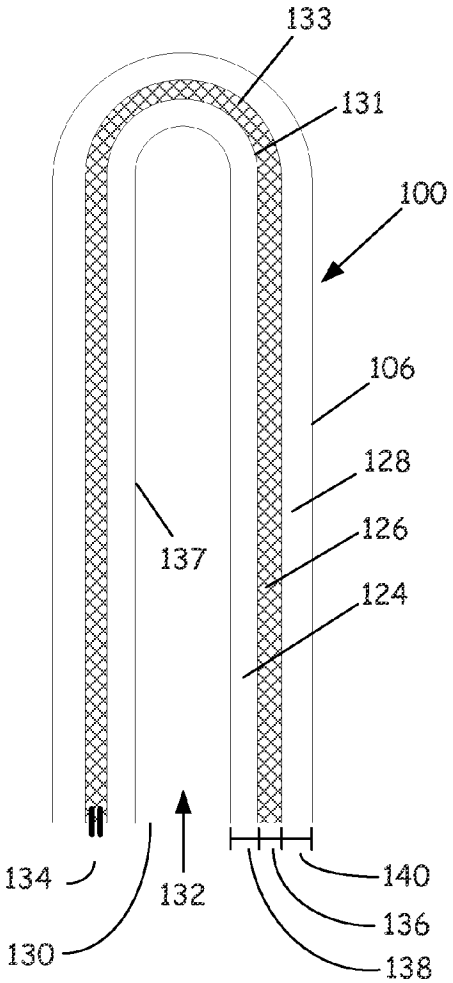
FIG. 4 is a cross-sectional view of the assembly of FIG. 1 prior to introduction of a fluid substance into the assembly.

The middle layer 126 generally has a middle width 136 having a baseline width that is defined prior to introduction of any fluid substance (see FIG. 4). Subsequently, upon substantially filling the middle layer 126 with a fluid substance, the middle width 136 expands to an expanded middle width 136' (see FIG. 2). In certain embodiments, when the middle layer 126 is substantially devoid of a fluid substance, the middle width 136 approaches zero width.

The inner layer 124 and the outer layer 128 comprise of an insulating, shock absorbing material. In general, the shock absorbing material is deformable under application of force, and includes hysteresis properties such that when the applied force is removed, the material reverts to an unloaded shape. For example, prior to filling the middle layer 126 with a fluid substance, the inner layer 124 and the outer layer 128 may generally assume a inner width 138 and an outer width 140 (see FIG. 4). Subsequently, upon substantially filling the middle layer 126 with a fluid substance (and when the assembly 100 is coupled to the bollard structure 102), the inner width 138 and outer width 140 may be slightly reduced under compressive force to assume a reduced inner width 138' and reduced outer width 140' (see FIG. 5). In example embodiments, when the fluid substance is substantially removed from the middle layer 126, the reduced inner width 138' and reduced outer width 140' generally reverts back to the inner width 138 and outer width 140.

Similarly, in the event of an incident impact (e.g., a car bumper) upon the assembly 100 (and when the assembly 100 is coupled to the bollard structure 102), at least a portion of the reduced inner width 138' and the reduced outer width 140' may be reduced under compressive force to temporarily assume respective widths that are less than reduced inner width 138' and reduced outer width 140'. Accordingly, when the impact incident has passed, the inner layer 124 and the outer layer 128 are each restored to the reduced inner width 138' and the reduced outer width 140', respectively.

In example embodiments, the assembly 100 is removably positioned to the bollard structure 102 by coincidentally aligning the bollard structure 102 with the open end 130 of the assembly 100. Subsequently, the assembly 100 is moved in respective directions 135 such that the second end 122 of the bollard structure 102 enters into the cavity 132. When positioned together, the surface 104 of the bollard structure 102 is in contact with an interior surface 137 of the assembly 100 at a third interface 144. In example embodiments, pressure is induced between the interior surface 137 and the surface 104 by virtue of filling the middle layer 126 with a fluid substance such that the expanded middle width 136' of middle layer 126 is realized.

In one aspect, prior to positioning the assembly to the bollard structure 102, the middle layer 126 of the assembly 100 is at least partially expanded by introducing a fluid substance into the middle layer 126 via two-way valve 134. Subsequently, the bollard structure 102 is inserted into cavity 210. In this regard, ease in handling and positioned the assembly 100 to the bollard structure 102 is achieved.

Figure 3:
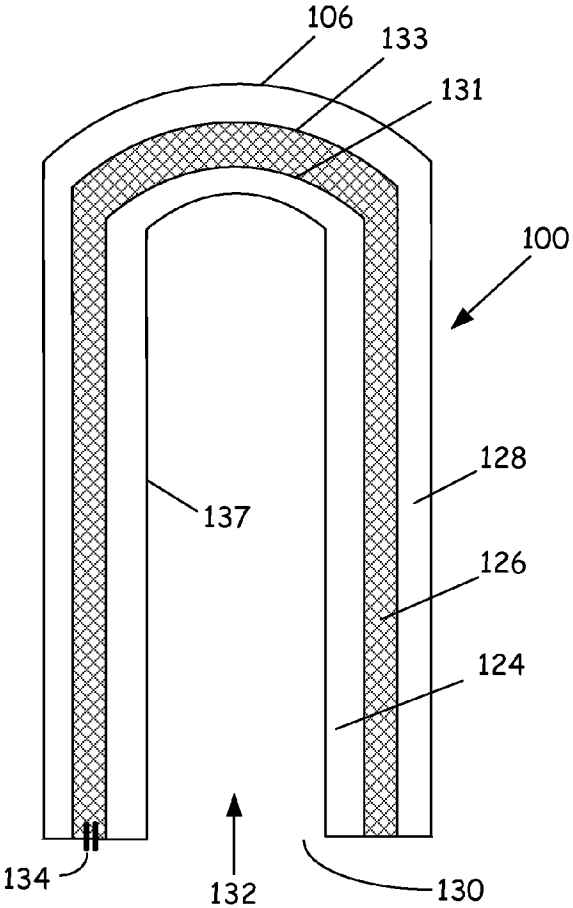
FIG. 3 is the bollard covering and advertisement assembly of FIG. 2.

In example embodiments, the external surface 106, the inner layer 124, middle layer 126, and outer layer 128 are generally non-rigid, and therefore the assembly 100 conforms to the shape of bollard structure 102 when positioned thereon. This is illustrated in FIGS. 2 and 3 which depicts the assembly 100 when the middle layer 126 is substantially filled with a fluid substance, and thus conforms to the shape of bollard structure 102. In the example embodiment, a closed end 146 of the assembly 100 assumes the hemispherical shape of the second end 122 of the bollard structure 102. The bollard structure 102 is omitted in FIG. 3 such that the open end 130 and the cavity 132 can be clearly designated. FIG. 4 depicts the assembly 100 prior to being positioned on the bollard structure 102, and, therefore, the closed end 146 assumes no particular shape.

Figure 5:
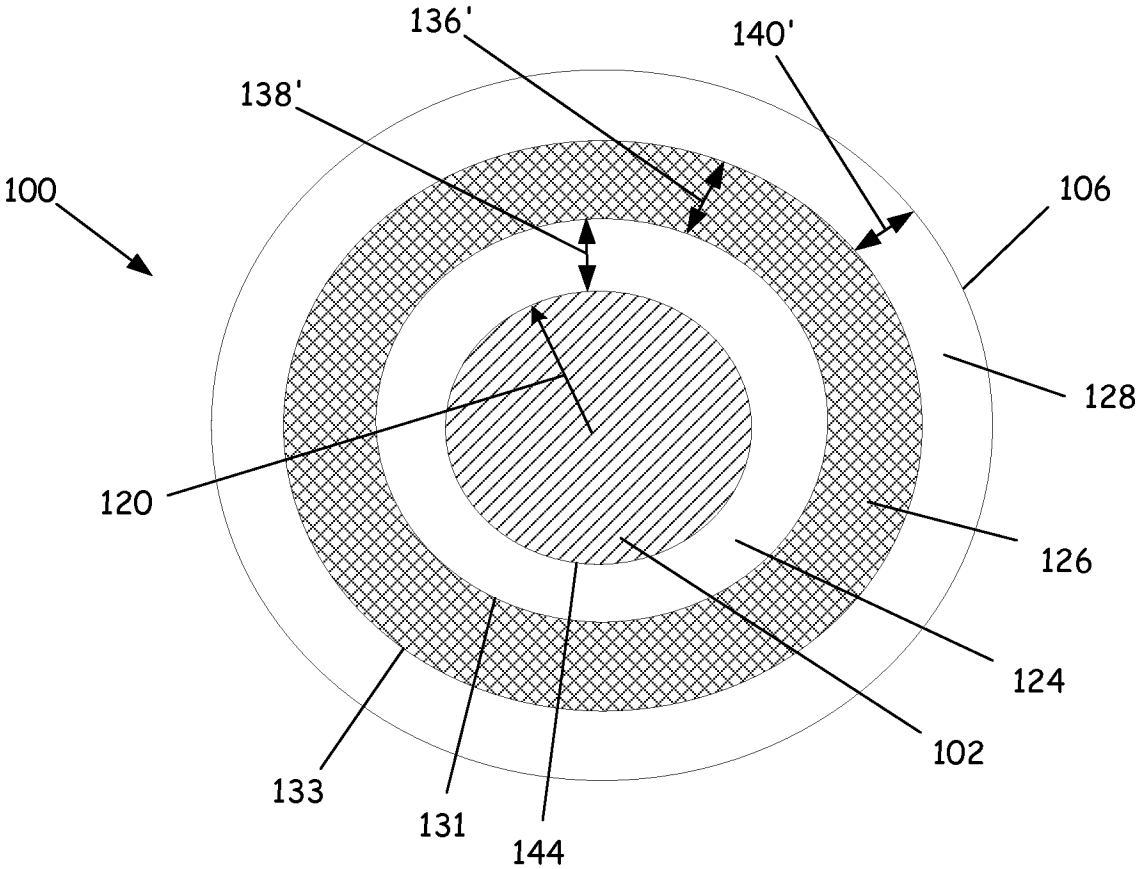
FIG. 5 is a top cross-sectional view A'-A' of the bollard covering and advertisement assembly and bollard structure of FIG. 2.

Referring now to FIG. 5, a cross-section A'-A' of the assembly 100 and the bollard structure 102 of FIG. 2 is shown. In the example embodiment, it is clearly seen that the assembly 100 conforms to the cylindrical shape of the bollard structure 102 along a longitudinal axis that is coincident with the length 118 dimension of the bollard structure 102.

Figure 6:
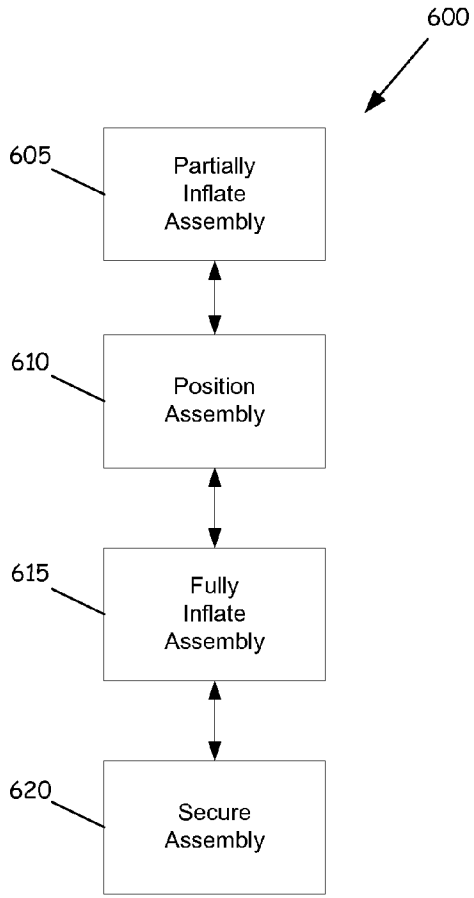
FIG. 6 is an example method of positioning a combined bollard covering and advertisement assembly to a bollard structure.

Referring now to FIG. 6, an example method 600 is shown for coupling a combined bollard covering and advertisement assembly to a bollard structure. In example embodiments, the bollard covering and advertisement assembly is an inflatable barrier that conforms to the shape of a bollard structure. The bollard covering and advertisement assembly additionally includes one or more advertising indicia to increase the visibility of the bollard structure and further convey messages.

Initially, at operation 605, the assembly is partially inflated by introducing a fluid substance into a middle layer of the assembly via a two-way valve. In example embodiments, the assembly is generally non-rigid and therefore partial inflation facilitates placement of the assembly to the bollard structure. Next, at operation 610, the example assembly is positioned to the bollard structure. In example embodiments, the assembly is removably positioned to the bollard structure by coincidentally aligning the bollard structure with the open end of the assembly. Subsequently, the assembly is moved in a parallel direction with a longitudinal axis of the bollard structure such that an end of the bollard structure enters into cavity of the assembly.

At operation 615, the middle layer is substantially filled with the fluid substance. In example embodiments, when the middle layer is filled with the fluid substance, a pressure force is imparted on a surface of the bollard structure that is covered by the assembly. At operation 620, the assembly is secured to the bollard structure, thereby protecting the bollard from exposure to weather and further protection from contact with other structures. In certain embodiments, the assembly is secured to the bollard structure by a locking mechanism such that the assembly can not be removed without a requisite unlocking mechanism.

The above disclosure is directed to a bollard covering and advertisement assembly constructed to protect a bollard structure from damage incurred from various surface and structural degrading phenomena, and include one or more advertising indicia to increase the visibility of the bollard structure and convey messages. However, the covering and advertisement assembly is not limited to applications involving bollards. In general, the disclosed covering and advertisement assembly can be used as a covering for any structure or apparatus. For example, the disclosed covering and advertisement assembly can used as a covering for gas pumps, street signs, light posts, and many others applications.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A bollard covering and advertisement assembly comprising:

a first and second insulating layer, wherein the first layer includes an exposed external surface formed from a damage resistant material; and an inflatable third layer positioned between the first and second layers, wherein the first, second and third layers are adjacently positioned and affixed with respect to one another;

wherein the first, second and third layers form a flexible assembly including at least one open end adjacent to a cavity;

wherein the assembly is configured to be removably coupled to at least a portion of a bollard structure by aligning an end of the bollard structure with the open end of the assembly and inserting the end of the bollard structure into the cavity;

wherein the assembly is configured to be coupled to the bollard structure by inducing a surface pressure between an interior surface of the second layer and a surface of the bollard structure upon substantially filling the third layer with a fluid substance when the assembly is positioned on the bollard structure; and wherein one or more advertising indicia are coupled to the external surface.

2. The assembly of claim 1, wherein the flexible assembly is U-shaped.

3. The assembly of claim 1, wherein prior to positioning the assembly to the bollard structure, the assembly is at least partially expanded by introducing a fluid substance into the third layer.

4. The assembly of claim 1, wherein the assembly conforms to the shape of bollard structure when positioned thereon.

5. The assembly of claim 1, wherein the assembly at least partially covers a surface of the bollard structure and protects the bollard structure.

6. The assembly of claim 1, wherein the one or more advertising indicia include at least one of an audio message and a video message.

7. The assembly of claim 1, wherein at least one of the one or more advertising indicia are embedded within the external surface.

8. The assembly of claim 1, wherein at least one of the one or more advertising indicia are incorporated into a structure separate from the external surface, wherein the separate structure is one of removably and permanently coupled to the external surface.

9. The assembly of claim 1, wherein the third layer is a flexible diaphragm, and wherein a fluid substance is transferred between the third layer and an external source via a two-way valve.

10. The assembly of claim 1, wherein the insulating material of the first and second layer is deformable and includes hysteresis.

11. A combined bollard covering and advertisement assembly, wherein the assembly is configured to be removably coupled to at least a portion of a bollard structure to protect the bollard structure from one or more surface damaging phenomena, the assembly comprising:

a first and second layer each formed from an insulating material, wherein the first layer includes an exposed external surface formed from a durable, damage resistant material; and an inflatable third layer positioned between the first and second layers, wherein the first, second and third layers are adjacently positioned and affixed with respect to one another to integrally form a flexible U-shaped assembly including an open end adjacent to a cavity;

wherein the assembly is configured to be coupled to the bollard structure by inducing a surface pressure between an interior surface of the second layer and a surface of the bollard structure upon substantially filling the third layer with a fluid substance when the assembly is positioned on the bollard structure; and wherein one or more indicia each comprising an advertisement message are coupled to the external surface.

12. The assembly of claim 11, wherein the one or more indicia each include at least one of an audio and a video message.

13. The assembly of claim 11, wherein the one or more indicia are at least one of: embedded within the external surface; and incorporated into a structure separate from the external surface, wherein the separate structure is one of removably and permanently coupled to the external surface.

14. The assembly of claim 11, wherein the third layer is a flexible diaphragm, and wherein a fluid substance is transferred between the third layer and an external source via a two-way valve, the fluid substance including at least one of a liquid, a gas, and a colloid.

15. A method of coupling a combined bollard covering and advertisement assembly to a bollard structure, the method comprising:

partially inflating the assembly by introducing a fluid substance into an inflatable middle layer of the assembly, wherein the middle layer is adjacently positioned and affixed between a first and a second layer, and wherein the first layer includes an exposed external surface comprising of one or more advertising indicia;

coupling the assembly to the bollard structure, wherein the assembly is removably coupled to the bollard structure by coincidentally aligning an end of the bollard structure with an open end of the assembly and moving the assembly in a parallel direction with respect to a longitudinal axis of the bollard structure such that the end of the bollard structure is inserted into a cavity adjacent to the open end of the assembly; and inflating the middle layer with a fluid substance, wherein upon substantially filling the middle layer with the fluid substance, a pressure force is imparted on a surface of the bollard structure covered by the assembly, and wherein the pressure force couples the assembly to the bollard structure.

16. The method of claim 15, further comprising introducing the fluid substance into the inflatable middle layer of the assembly via a two-way valve.

17. The method of claim 16, further comprising filling the middle layer with a fluid substance comprising of at least one of a liquid, a gas, and a colloid, wherein the fluid substance is transferred between the middle layer and an external source via a two-way valve.

18. The method of claim 15, further comprising securing the assembly to the bollard structure with a locking mechanism.

* * * * *